US009532921B2

(12) United States Patent
Wang et al.

(10) Patent No.: US 9,532,921 B2
(45) **Date of Patent: *Jan. 3, 2017**

(54) MASSAGE CHAIR

(71) Applicant: NINGBO COMFORT HEALTH EQUIPMENT CO., LTD., Fenghua/Zhejiang (CN)

(72) Inventors: Haiming Wang, Ningbo/Zhejiang (CN); Qiankun Gu, Xiamen/Fujian (CN); Weifeng Li, Linxiang/Hunan (CN)

(73) Assignee: NINGBO COMFORT HEALTH EQUIPMENT CO., LTD. (CN)

( * ) Notice: Subject to any disclaimer, the term of this patent is extended or adjusted under 35 U.S.C. 154(b) by 289 days.

This patent is subject to a terminal disclaimer.

(21) Appl. No.: 14/156,234

(22) Filed: Jan. 15, 2014

(65) Prior Publication Data

US 2015/0051526 A1 Feb. 19, 2015

(30) Foreign Application Priority Data

Aug. 14, 2013 (CN) ..... 2013 2 0497217 U

(51) Int. Cl.
*A61H 15/00* (2006.01)
*A47C 7/70* (2006.01)
*A47C 11/00* (2006.01)

(52) U.S. Cl.
CPC ..... *A61H 15/0078* (2013.01); *A47C 7/70* (2013.01); *A47C 11/00* (2013.01); *A61H 2015/0014* (2013.01); *A61H 2201/0149* (2013.01); *A61H 2201/1215* (2013.01); *A61H 2201/1623* (2013.01); *A61H 2201/1645* (2013.01); *A61H 2201/1664* (2013.01); *A61H 2201/1676* (2013.01); *A61H 2201/5028* (2013.01); *A61H 2201/5061* (2013.01)

(58) Field of Classification Search
CPC ..... A61H 2201/1215; A61H 2201/1623; A61H 2201/5061; A61H 2201/1664; A61H 2201/1676; A61H 2201/0149; A61H 2201/5028; A61H 2201/1645; A61H 15/0078; A61H 2015/00; A61H 2015/0014; A61H 39/00; A61H 39/04; A61H 2205/062; A61H 2205/081; A61H 2205/10; A61H 7/00; A61H 7/007; A47C 7/70; A47C 11/00
See application file for complete search history.

(56) References Cited

U.S. PATENT DOCUMENTS 6,832,991 B1 * 12/2004 Inada ..... A61H 39/04 601/100
2004/0243030 A1 * 12/2004 Tanizawa ..... A61H 7/00 601/90
2015/0051525 A1 * 2/2015 Wang ..... A61H 15/0078 601/99
2015/0297441 A1 * 10/2015 Wang ..... A61H 15/0078 601/99

* cited by examiner

*Primary Examiner* — Quang D Thanh

(57) ABSTRACT

The present invention is a massage chair, having frame body with specific curve, a chair back located by the chair seat, wherein the chair back is adjusted properly by the chair seat for rotating and having a rotation angle; wherein the frame body including back section, buttock section and leg section, the buttock section has a downward curve and the leg section has an upward curve, thus, massage module can provide massage service to human thigh when the rotation angle is more than 110 degrees.

12 Claims, 13 Drawing Sheets

MASSAGE CHAIR

BACKGROUND OF THE INVENTION

Field of the Invention

The present invention is related to a massage chair providing massage to human back and buttock.

Description of Related Art

The muscular endurance and physical strength of human body can be developed by exercise or strength training. Strong muscle is capable of providing well sporting ability, as well as protecting viscous and bone from directly hurt at any emergency situation. Except muscle training, muscle tissue can be relaxed through massage therapy. Only relaxing muscle provides rest effect. Muscle needs rest to provide strength in any circumstance. Athlete has massage mostly after high competitive physical game or training.

Massage therapy reduces sporting injury produced by over exercise or physical sport, as well as painful contractions produced by fixed position. In addition to the athlete, normal people occasionally fix a specific posture for a period for work. This fixed posture might not require high force generated by muscle, after a period, however, muscle has contractions, and uncomfortable pain is fallowed with stuck blood. So that, proper massage is necessary to normal people.

Many massage devices have been developed for convenient massage service, including foot massage device, leg massage device, and massage chair. Massage chair has the most complicated structure with the highest level design. Please refer to FIG. 1, which demonstrates a conventional massage chair. FIG. 1 shows a conventional massage chair, including a chair back P1 and a chair seat P2, wherein the chair back P1 and the chair seat P2 both have massage device respectively. The massage device can process massage service at fixed posture, or process massage service as moving through the chair back P1 and the chair seat P2; the massage device at the chair back P1 can provide massage service to human back, and the massage device at the chair seat P2 can provide massage service to human buttock, or any part between human back and buttock; furthermore, the conventional massage chair might has leg massage device P3, so the human body and leg can process massage service.

Please refer to FIG. 2, which demonstrates an L-type curved track module for conventional massage chair. The L-type curved track module Q1 shown in FIG. 2 can be disposed in conventional massage chair. The L-type curved track module Q1 is formed by left track Q11 and right track Q12 bond with at least one back bending tube Q13, wherein the left track Q11 and right track Q12 are parallel; any mechanical massage device can be disposed between the left track Q11 and right track Q12, and move along the L-type curved track module Q1 from neck, human back, then through caudal to buttock and thigh. The L-type curved track module for conventional massage chair disclosed in FIG. 2 is used to provide massage service like shiatsu and kneading to human body including parts of back, human buttock and thigh. However, the L-type curved track module Q1 has fixed curve, man sitting on the conventional massage chair is forced stay at exactly curve posture to keep certain massage service.

The L-type curved track module of FIG. 2 provides certain massage service and effect, but man sitting on the conventional massage chair must stay at exactly curve posture during massage service. Human muscle is hardly received relax when fixed posture is necessary during massage service, so massage effect is hardly brought out with well quality, especially to the man who already stay at fixed posture in work for long period; human body has partially uncomfortable painful issue after suffering unbalance pressure load on muscle when fixed posture cause muscle strength out of limit; as description, it is clear the L-type curved track module in FIG. 2 has disadvantage need to improve.

Due to uncomfortable painful issue on human body need to be avoided during massage service with fixed posture, another conventional massage chair is also been designed. Please refer to a FIGS. 3A and 3B, which demonstrate another conventional massage chair. A conventional massage chair in FIG. 3A provides a leading track (13), having an upper pin shaft and a lower pin shaft, wherein the upper pin shaft connects to a pin hole of a frame, the lower pin shaft connects to an end of a bar, so the leading track (13) swings around a point in terms of pivot used to connect the frame and the leading track (13); as shown in FIG. 3A, the conventional massage chair has two status, and the posture of man sitting on chair also changes with status, so the uncomfortable painful issue produced by fixed posture can be reduced. In the status of FIG. 3A, massage chair only provides human back massage, human buttock has no massage service; in the status of FIG. 3B, man can lay on chair, human buttock might has massage service by massage device (14). According to the FIG. 3A and FIG. 3B, the massage chair cannot provide the massage service from human neck to human thigh like the L-type curved track module in FIG. 2, thus, it is clear the massage chair in FIG. 3A and FIG. 3B has disadvantage need to improve.

Everyone has different necessities, physical conditions and work environments, so massage service need to adjust as different status, thus, it is clear the massage chair has improvement in many respect. In view of the aforementioned drawbacks of the conventional massage chair, the inventor of the present invention based on years of practice experience in the related industry to conduct extensive researches and experiments, and finally developed a massage chair in accordance with the present invention to overcome the drawbacks of the prior art.

SUMMARY OF THE INVENTION

Therefore, it is a primary objective of the invention to provide a massage chair, wherein leg section has downward curve, so that, the angle between the chair back and the chair seat can be bent properly, so as human body stretch, and achieving complete massage effect.

To achieve the aforementioned objective, the present invention provides a massage chair, including: a chair body, capable of carrying human body, and having a chair back and a chair seat, wherein the chair back is located by the chair seat and having a rotation angle, also adjusted properly by the chair seat for rotating; wherein the chair back has a back massage surface, the chair seat has a seat massage surface, and both are made by leather; a frame body, being stiffness frame, and being welded within the chair body, also having a rigid bar located in the frame body, a left frame and right frame; wherein the left frame and right frame have relative shape, and being connected each other by at rigid bar, in addition, the left frame and the right frame of the frame body are both formed internal slide track respectively, and both further comprising: a back section, being located and fixed in the chair back, and having a massage distance from the back massage surface; wherein the back section of the left frame is connected with the back section of the right frame; a buttock section, being located in both the chair back and the chair seat, and connecting to the back section; wherein the buttock section has an upward curve, and a massage distance from both the back massage surface and the seat massage surface; and a leg section, being located under the chair seat, and connecting to the buttock section; wherein the leg section has a downward curve relative to the buttock section; when the rotation angle is less than 110 degree, the leg section is away from the seat massage surface more than the massage distance; wherein the leg section of the left frame are connected to the leg section of the right frame; a massage module, being located within the frame body and between the internal slide track, able to slide from the back section, the buttock section to the leg section, and from the leg section, the buttock section to the back section; wherein the massage module can provide a massage service at both the chair back and the chair seat; wherein the massage module touches the back massage surface and the seat massage surface during massage service, and pushes the back massage surface and the seat massage surface respectively to provide the massage service; in addition, the massage module has a plurality of gearwheel and a plurality of sliding wheel, wherein the sliding wheels are disposed by the gearwheels; a supporting shelf, being located and flanked the frame body, connecting to the frame body, having two first rotating center, and capable of carrying the chair seat; wherein the frame body is connected to the first rotating center; and an electrical driver, driving the massage module to provide massage service, also driving the frame body to rotate around the first rotating center, so that, the chair back is adjusted properly by the chair seat for rotating.

DETAILED DESCRIPTION OF THE PREFERRED EMBODIMENTS

The technical contents and characteristics of the present invention will be apparent with the detailed description of a preferred embodiment accompanied with related drawings as follows. It is noteworthy that the drawings are provided for the purpose of illustrating the present invention, but not intended for limiting the scope of the invention.

Figure 1:
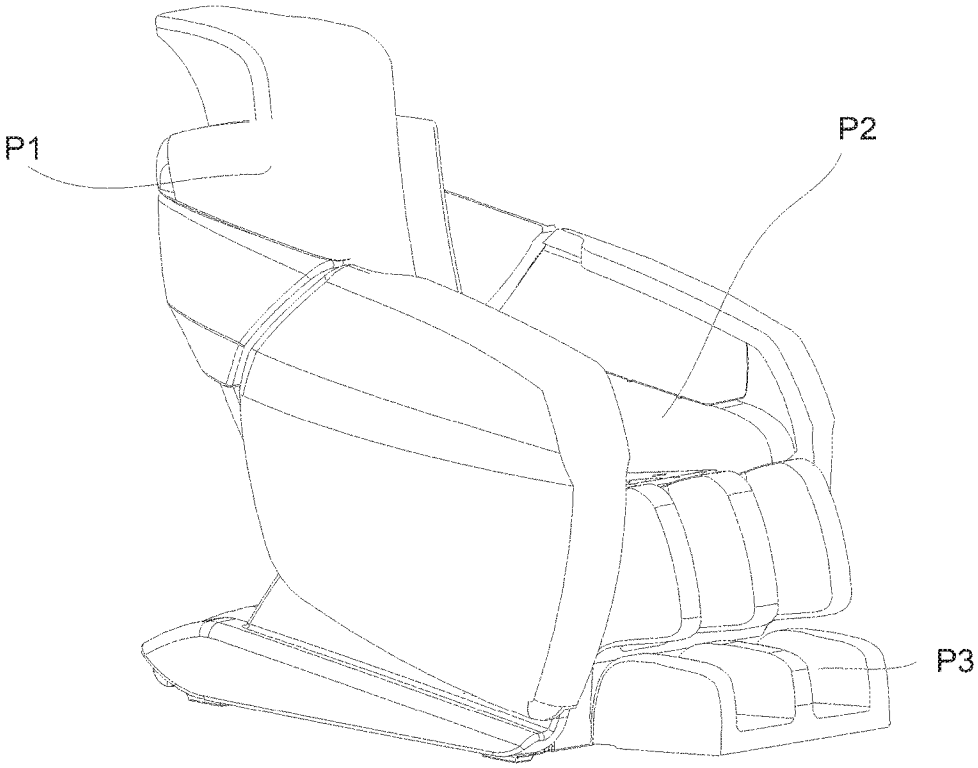
FIG. 1 (PRIOR ART)
FIG. 1 demonstrates a conventional massage chair.
Figure 2:
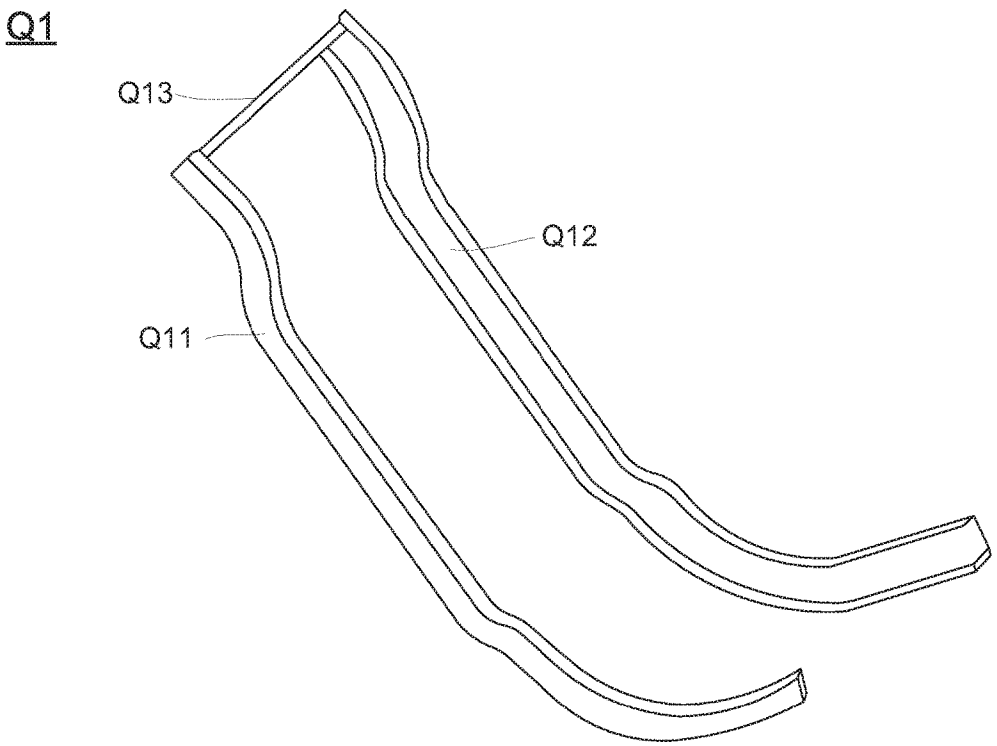
FIG.2 (PRIOR ART)
FIG. 2 demonstrates an L-type curved track module for conventional massage chair.
Figure 3A:
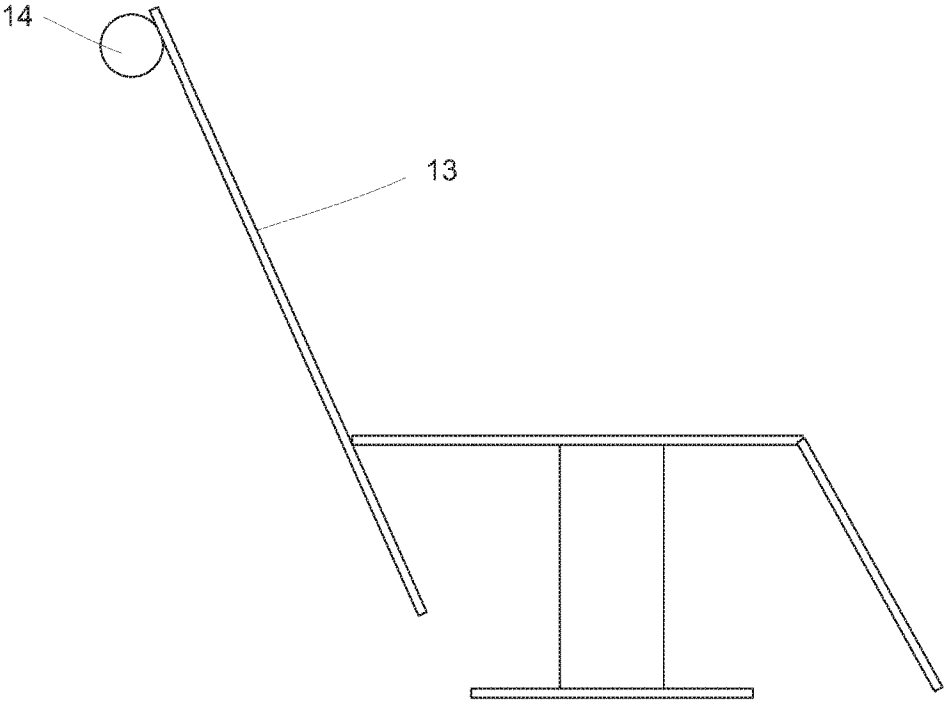
FIG.3A (PRIOR ART)
FIG. 3A and FIG. 3B demonstrate another conventional massage chair.
Figure 3B:
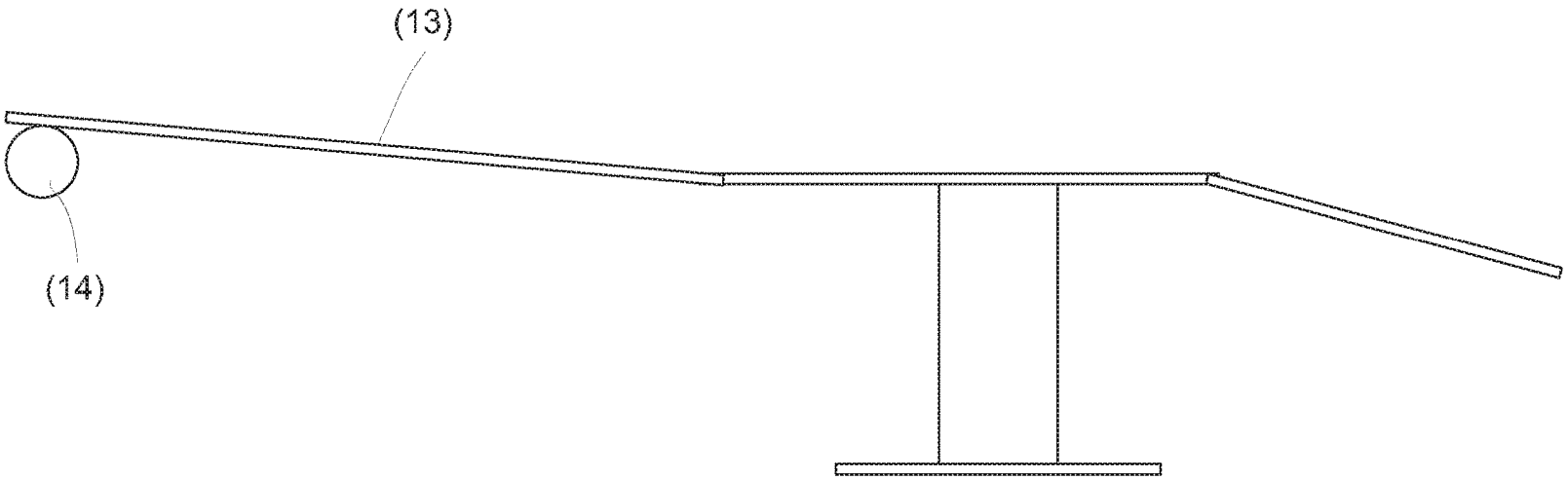
FIG.3B (PRIOR ART)
Figure 4:
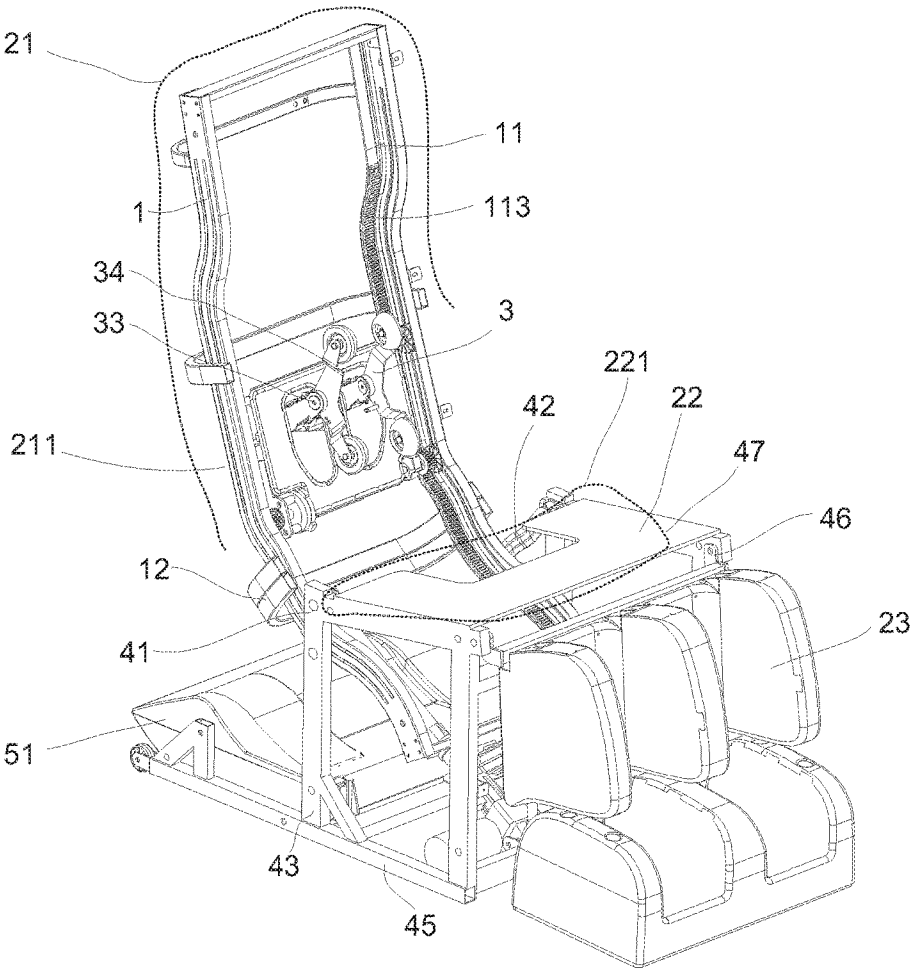
FIG. 4 demonstrates a side view of the massage chair according to the invention.
Figure 5:
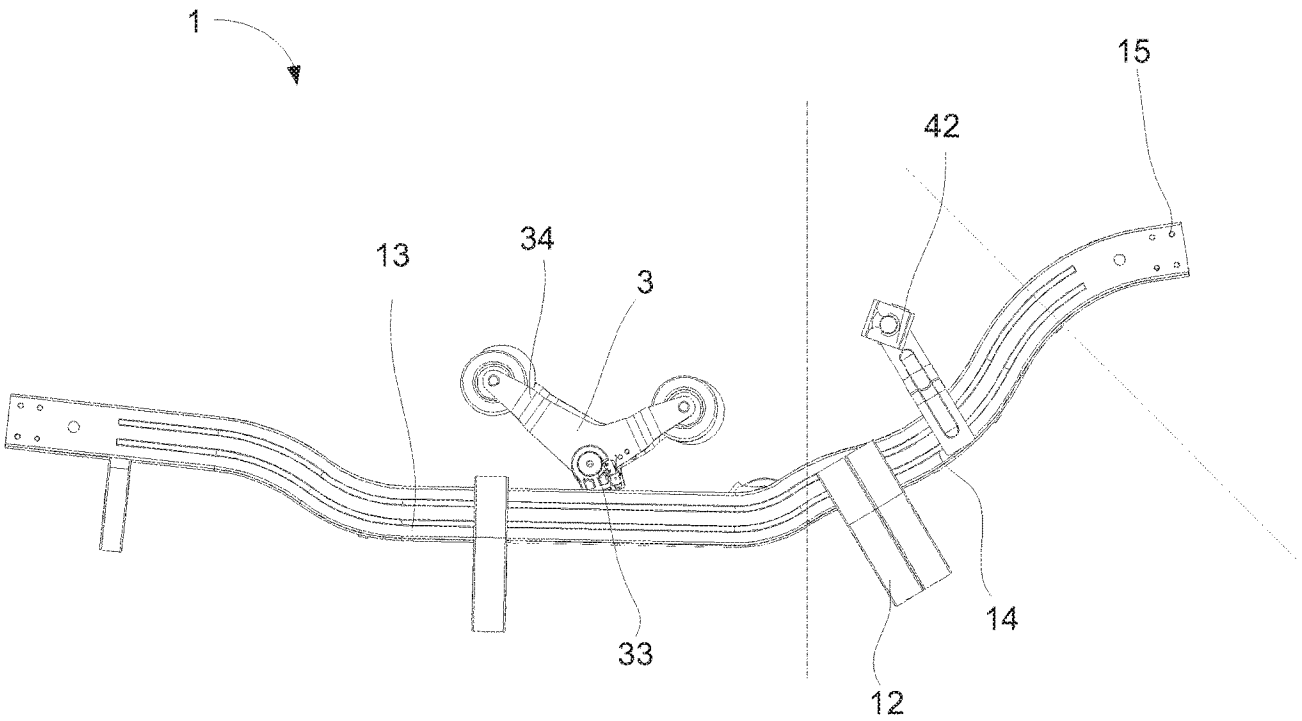
FIG. 5 demonstrates a side view of the frame body used in this invention.
Figure 6:
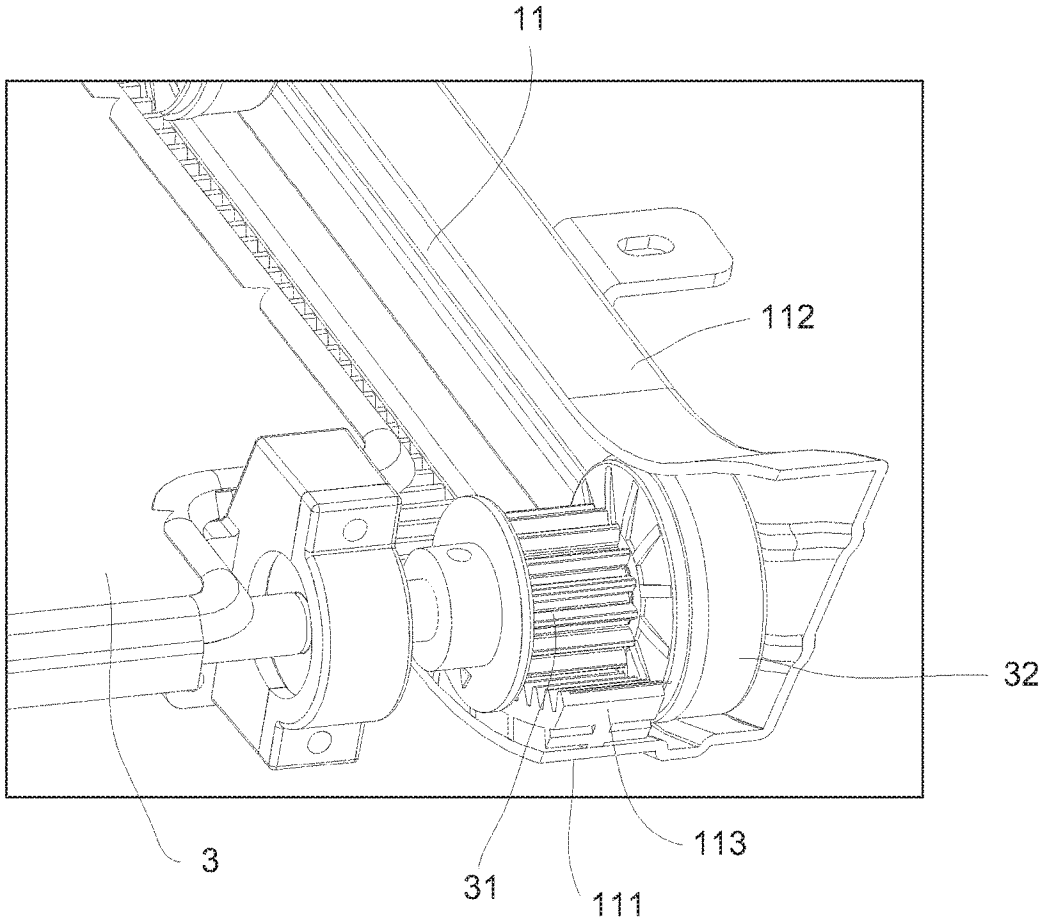
FIG. 6 demonstrates a partial section view of the internal slide track used in this invention.

Please refer to FIG. 4 to FIG. 6. FIG. 4 demonstrates a stereo view of the massage chair according to the invention, FIG. 5 demonstrates a side view of the frame body used in this invention, and FIG. 6 demonstrates a partial section view of the internal slide track used in this invention. As depicted in FIG. 4, this invention is a massage chair, including: a chair body 2, capable of carrying human body, and having a chair back 21 and a chair seat 22, wherein the chair back 21 is located by the chair seat 22 and having a rotation angle, also adjusted properly by the chair seat 22 for rotating; wherein the chair back 21 has a back massage surface 211, the chair seat 22 has a seat massage surface 221, and both are made by leather material, or some other soft material, including nonwoven fabric; however, leather is the best choice, leather can keep clean, dust or dirty easily wash away, soft enough and long lifetime; so the back massage surface 211 and the seat massage surface 221 deform when suffering certain pressure or force; a frame body 1, being stiffness frame, and being located within the chair body 2, also having a rigid bar 12 located in the frame body 1, a left frame and right frame; wherein the left frame and right frame have relative shape, and being connected each other by at rigid bar 12, in addition, the left frame and the right frame of the frame body 1 are both formed internal slide track 11 respectively, and both further comprising: a back section 13, being located and fixed in the chair back 21, and having a massage distance from the back massage surface 211; wherein the back section 13 of the left frame is connected with the back section 13 of the right frame; a buttock section 14, being located in both the chair back 21 and the chair seat 22, and connecting to the back section 13; wherein the buttock section 14 has an upward curve, and a massage distance from both the back massage surface 211 and the seat massage surface 221; and a leg section 15, being located under the chair seat 22, and connecting to the buttock section 14; wherein the leg section 15 has a downward curve relative to the buttock section 14; when the rotation angle is less than 110 degree, the leg section 15 is away from the seat massage surface 221 more than the massage distance; wherein the leg section 15 of the left frame are connected to the leg section 15 of the right frame; a massage module 3, being located within the frame body 1 and between the internal slide track 11, able to slide from the back section 13, the buttock section 14 to the leg section 15, and from the leg section 15, the buttock section 14 to the back section 13; wherein the massage module 3 can provide a massage service at both the chair back 21 and the chair seat 22; wherein the massage module 3 touches the back massage surface 211 and the seat massage surface 221 during massage service, and pushes the back massage surface 211 and the seat massage surface 221 respectively to provide the massage service; in addition, the massage module 3 has a plurality of gearwheel 31 and a plurality of sliding wheel 32, wherein the sliding wheels 32 are disposed by the gearwheels 31; moreover, the massage module 3 has two massage arm, controlled by electrical motor, able to push and press human body through the chair back 21 and the chair seat 22; moreover, the massage module 3 has a pressure sensor 33, sensing pressure from the back massage surface 211 and the seat massage surface 221; a supporting shelf 4, being located and flanked the frame body 1, connecting to the frame body 1, having two first rotating center 41, and capable of carrying the chair seat 22; wherein the frame body 1 is connected to the first rotating center 41; and an electrical driver, including a massage driving device 51 and a frame body rotating device 52; wherein the massage module 3 receives power and instruction from the massage driving device 51 to provide massage service; the frame body rotating device 52 connects to the rigid bar 12 of the frame body 1, and drives the frame body 1 to rotate around the first rotating center 41, so that, the chair back 21 is adjusted properly by the chair seat 22 for rotating; wherein the pressure sensor 33 senses pressure, and transfers a pressure signal to the electrical driver, the electrical driver then drives the frame body 1 to rotate around the first rotating center 41, and adjusts the massage service according to the pressure signal; wherein the frame body rotating device 52 is located under the chair seat 22. As shown in figure, the left frame and right frame are fixed by at least three bars, including a bar connected between the back section 13 of left frame and the back section 13 of right frame, a bar connected between the leg section 15 of left frame and the leg section 15 of right frame, and a rigid bar 12; the frame body 1 is not solid enough if the left frame and right frame fixed only by rigid bar 12, so two bar located in back section 13 and leg section 15 are necessary. The bars can be fixed by screw or welding, mostly, welding is best choice, providing speed manufacture, and solid frame; screw can be used if separation is necessary.

As mentioned, the massage distance in the invention means a distance that the massage module 3 can provide massage service to human body, if a distance larger than massage distance, the massage module 3 cannot provide massage service, on the other hand, a distance shorter than massage distance, the massage module 3 can provide massage service; also in figure, for example, the massage distance can be a distance from the frame body 1 to the back massage surface 211, so a distance between the massage module 3 and the back massage surface 211 is absolutely shorter than massage distance; as shown in figure, part of the massage module 3 even exceed the back massage surface 211.

Aforementioned, two terminals of the rigid bar 12 are fixed on the external surface of the frame body 1, as shown in figure, the rigid bar 12 fixed on area around the back section 13 and the buttock section 14; in the invention, the buttock section 14 formed as upward curve is for accommodating human buttock, so the massage module 3 can provide complete massage service to human buttock when sliding through the buttock section 14 of the frame body 1; due to human buttock has different size, the upward curve of the buttock section 14 can be customize properly, so the buttock section 14 has an upward curve of radius within 110 mm to 210 mm; in the invention, when the rotation angle is less than 110 degree, the leg section 15 is away from the seat massage surface 221 more than the massage distance, so massage module 3 cannot provide massage service to human body as the massage module 3 sliding through the leg section 15; the massage module 3 can only provide massage service to human body when the rotation angle is more than 110 degree, therefore, the leg section 15 has a downward curve of radius within 90 mm to 270 mm; the massage module 3 has hammer 34 to provide massage service as shown in FIGS. 4 and 5, hammer 34 can be rotated by the massage driving device 51, the pressure sensor 33 is located at the point where the hammer 34 rotates, so the pressure sensor 33 can sense hammer 34 rotation status, and verify whether the pressure from the back massage surface 211 and the seat massage surface 221 is under limits or not, wherein the limits can be set and stored in the massage driving device 51; if pressure is out of limits, the massage driving device 51 can lower down power to the massage module 3, or even turn off, also, change instruction to massage module 3, then change massage service to provide better massage service fit to human; if pressure is under limits, the massage driving device 51 can boosts power to massage module 3, also change instruction to massage module 3, and change massage service to provide better massage service fit to human.

As above description, in the invention, the buttock section 14 has an upward curve connected to the downward curve of the leg section 15; however, a proper line can be put between the buttock section 14 and the leg section 15 properly for custom.

Please refer to FIG. 6, each internal slide track 11 further includes a rack and pinion placing surface 111 and a rack and pinion drive 113, the rack and pinion drive 113 is fixed on the rack and pinion placing surface 111; moreover, the massage module 3 has a plurality of gearwheel 31 matching and rotating on the rack and pinion drive 113; in addition, each internal slide track 11 further includes a sliding wheel accommodating slot 112; wherein the sliding wheel accommodating slot 112 is connected by the rack and pinion placing surface 111, and accommodates a plurality of sliding wheel 32 of the massage module 3; wherein the sliding wheel 32 of the massage module 3 and gearwheel 31 of the massage module 3 have the same rotation center; in the invention, the rack and pinion placing surface 111 has specific key or slot, and the rack and pinion drive 113 also has specific key or slot at the back to match the rack and pinion placing surface 111, so the rack and pinion drive 113 can be placed on the rack and pinion placing surface 111 firmly, not sliding away by unexpected force; the rack and pinion drive 113 sliding away can lead the massage module 3 stepping abnormal, and the massage module 3 has difference step at both side, the massage module 3 then steps out of the internal slide track 11; since the massage module 3 steps out of the internal slide track 11, and lost right position as expect, the massage module 3 can be broken, in addition to cause the rack and pinion drive 113 broken or tore apart.

Figure 7:
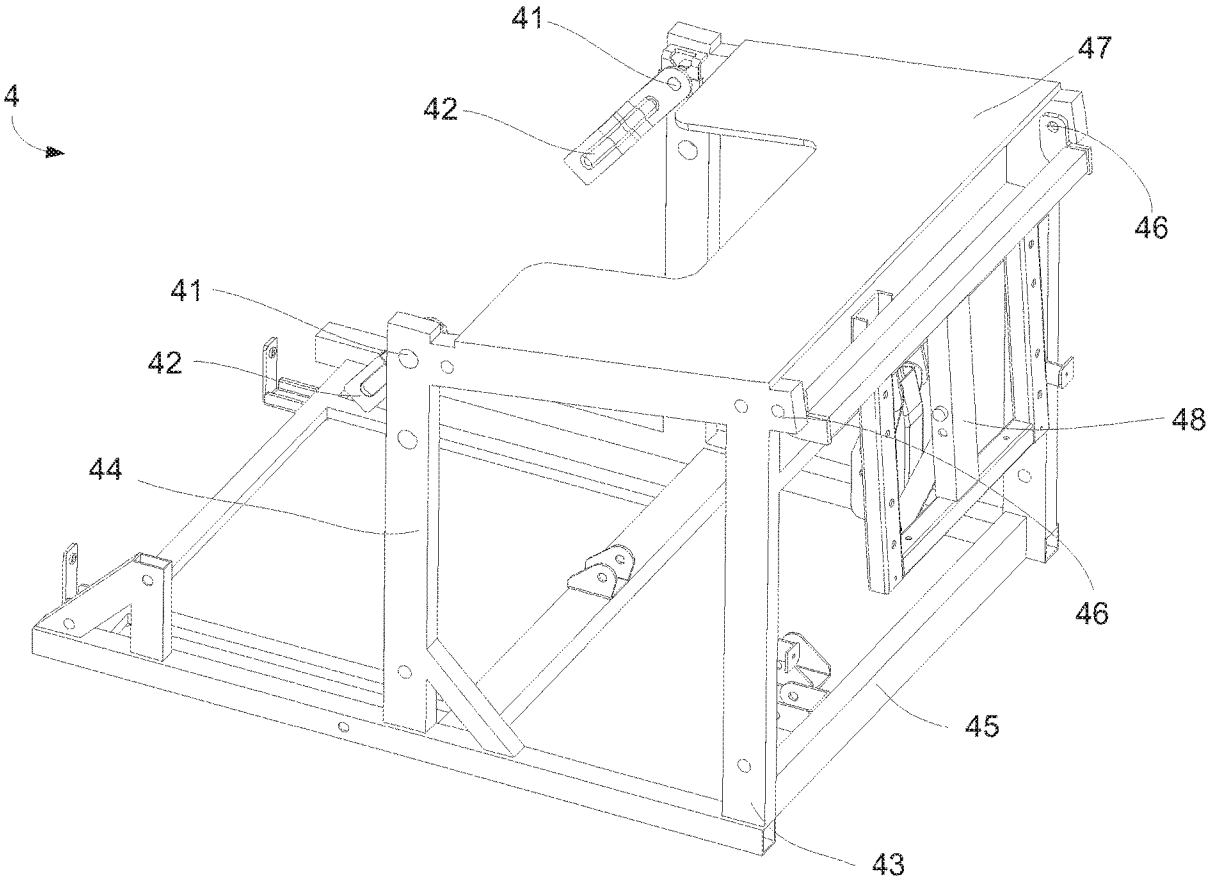
FIG. 7 shows a stereo view of the supporting shelf according to the invention.

Please refer to FIG. 7, which shows a stereo view of the supporting shelf according to the invention. As shown in FIG. 4 and FIG. 7, the supporting shelf 4 further includes a left supporter 43, a right supporter 44 and a base 45; the left supporter 43 and the right supporter 44 are placed on the base 45 to support the chair seat 22, and a flat plate 47 placed on the left supporter 43 and the right supporter 44; the two first rotating center 41 are formed at the left supporter 43 and the right supporter 44 respectively; in addition, two second rotating center 46 are formed at the left supporter 43 and the right supporter 44 respectively. The chair body 2 further includes a leg massage device 23, which is relative to the chair back 21, providing massage service to human leg, located by the chair seat 22, connected to the two second rotating center 46, and adjusted properly by the chair seat 22 for rotating. As shown in figure, a leg massage supporter 48 is connected to the back of the leg massage device 23 and the two second rotating center 46, so the leg massage device 23 can rotate around the second rotating center 46.

Please refer to FIG. 4 and FIG. 7. The supporting shelf 4 further includes two swing bars 42; wherein one terminal of the swing bar 42 connects to the frame body 1 and the other terminal of the swing bar 42 connects the first rotating center 41; wherein the frame body rotating device 52 drives the rigid bar 12 of the frame body 1, and the frame body 1 rotates around the first rotating center 41, so the chair back 21 is adjusted properly by the chair seat 22 for rotating. In the invention, the swing bar 42 can connect to the buttock section 14 of the frame body 1.

Figure 8A:
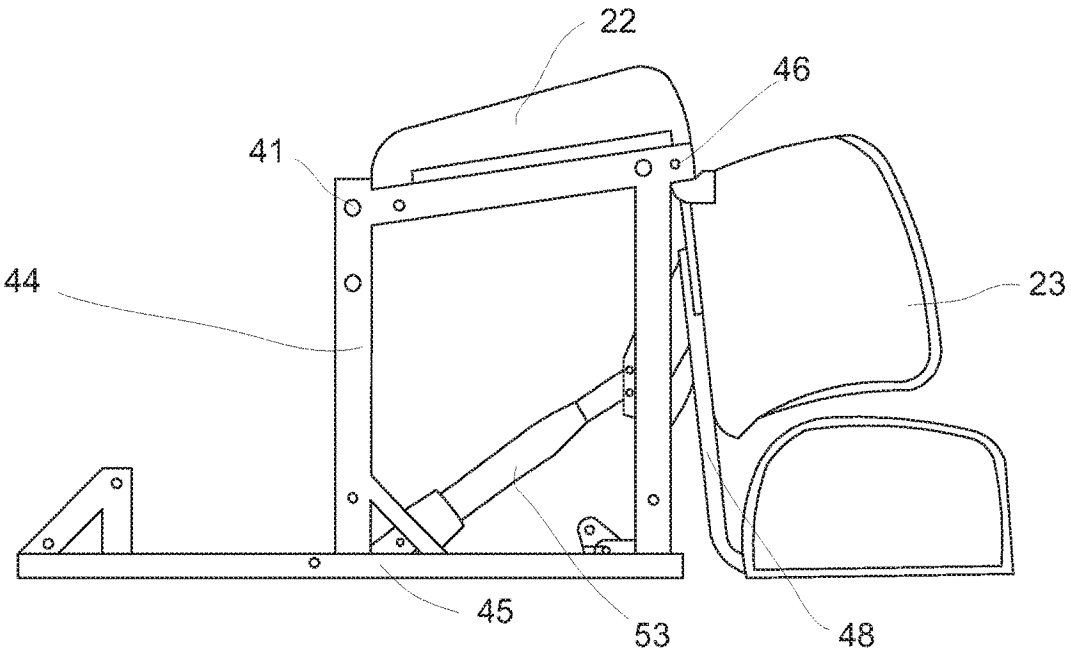
FIG. 8A and FIG. 8B demonstrate rotation position and practice of the leg massage device used in the present invention.
Figure 8B:
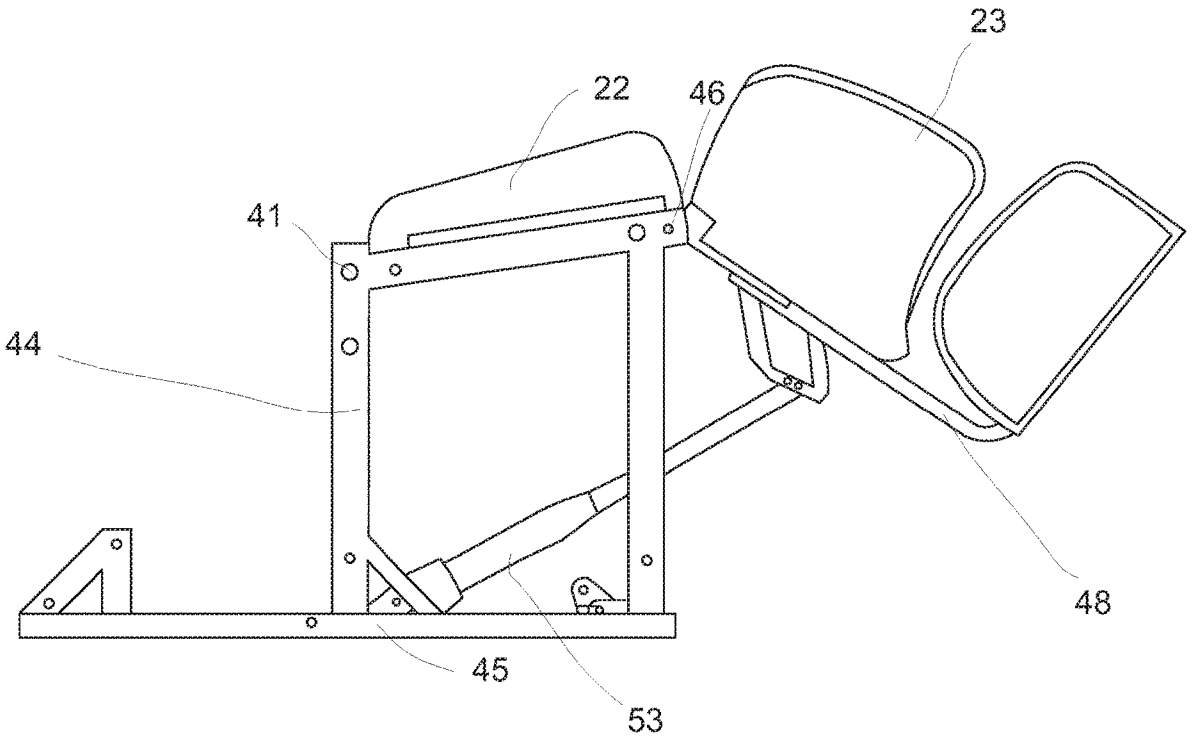

Please refer to FIG. 8A and FIG. 8B, both demonstrate rotation position and practice of the leg massage device used in the present invention. The electrical driver further includes a leg massage rotating device 53 connected to the leg massage device 23 of the chair body 2, and driving the leg massage device 23 to rotate around the second rotating center 46. As shown in FIG. 8A and FIG. 8B, the leg massage rotating device 53 is a electrical piston, in other practice, the leg massage rotating device 53 can be motor or other electrical driver which can provide rotation to the leg massage device 23. In FIG. 8A, the leg massage rotating device 53 is in the shortest status, and the leg massage device 23 is at the lowest position; in FIG. 8B, the leg massage rotating device 53 pushes the leg massage device 23 through the leg massage supporter 48, and the leg massage device 23 rotates around the second rotating center 46, and reaches the highest position.

Figure 9A:
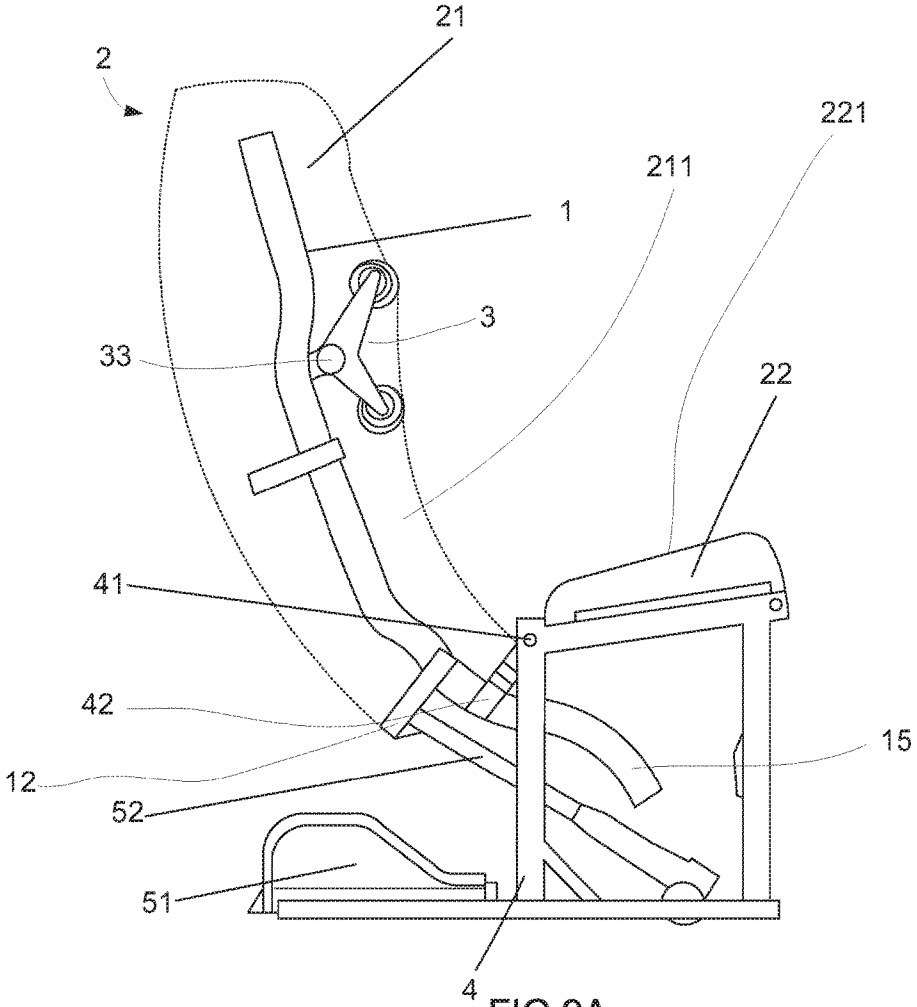
FIG. 9A to FIG. 9C demonstrate rotation position and practice of the frame body used in the present invention.
Figure 9B:
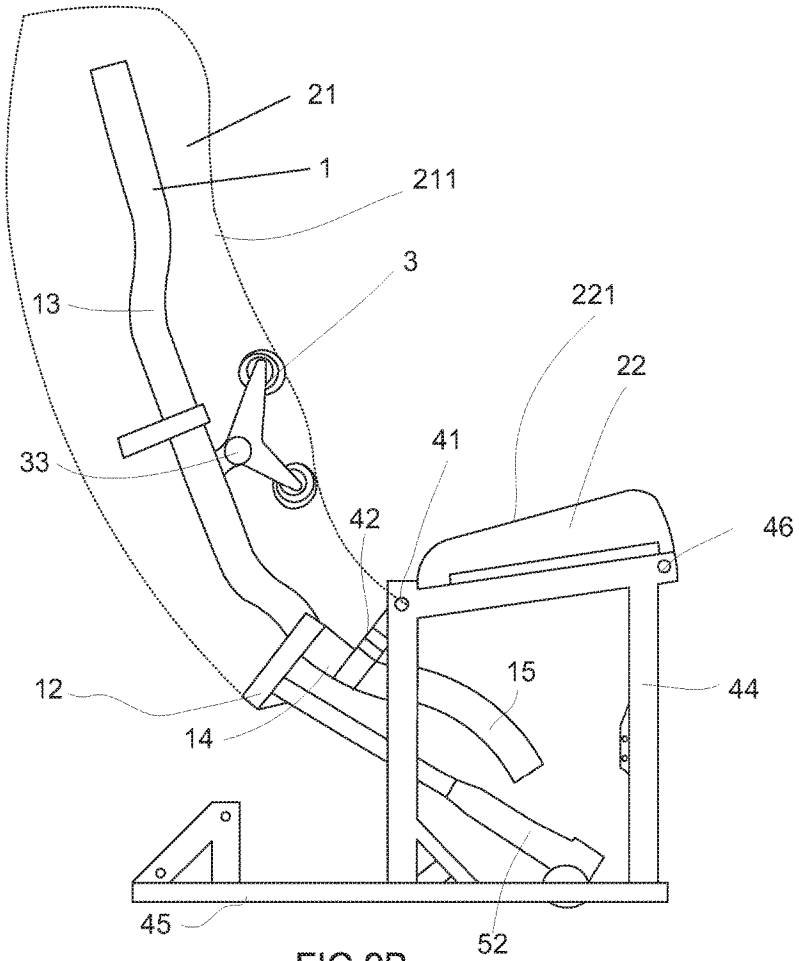
Figure 9C:
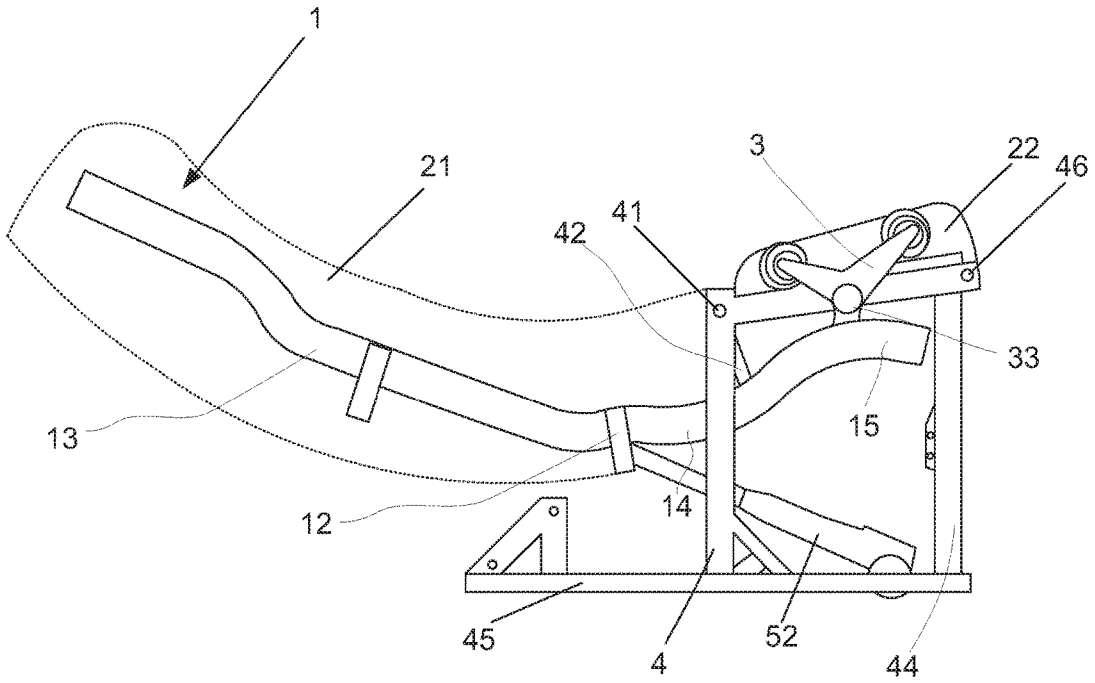

Please refer to FIG. 9A and FIG. 9C, demonstrate rotation position and practice of the frame body used in the present invention. As shown in figure, the frame body rotating device 52 is an electrical piston, in other practice, the frame body rotating device 52 can be motor or other electrical driver which can provide rotation to the frame body 1. In FIG. 9A, the frame body rotating device 52 pushes the frame body 1, in this instance, the chair back 21 located by the chair seat 22 has smallest rotation angle, less than 110 degree, and the leg section 15 is away from the seat massage surface 221 more than the massage distance, so the massage module 3 cannot provide massage service to human body at the leg section 15; in FIG. 9B, the frame body rotating device 52 does not rotate, the massage module 3 provides massage service to human back, in this instance, the frame body rotating device 52 can keep position without rotation, in practice, the frame body rotating device 52 can slightly rotate for custom, the massage module 3 can move as well; in FIG. 9C, the frame body rotating device 52 has the shortest status, the chair back 21 located by the chair seat 22 has largest rotation angle, more than 110 degree, and the leg section 15 is close to the seat massage surface 221 less than the massage distance, so the massage module 3 can provide massage service to human body at the leg section 15. Moreover, the pressure sensor 33 senses pressure from the back massage surface 211 and the seat massage surface 221, and transfers the pressure signal to the massage driving device 51 and the frame body rotating device 52, then the massage driving device 51 provides power and instruction to the massage module 3, so the massage module 3 provides massage service according the pressure signal, moreover, the frame body rotating device 52 drives the frame body 1 to rotate around the first rotating center 41 properly. The pressure sensor 33 might senses vibration pressure during the frame body 1 rotating around the first rotating center 41, if the pressure is out of limits, the frame body rotating device 52 can lower down the rotation speed, as so the massage driving device 51 adjusts massage service, to comfort human. As shown in FIG. 9A, if a human sit at the massage chair, the human back provides less pressure on the seat massage surface 221, thus the massage driving device 51 needs boost power to massage module 3 to provide proper massage service; during the frame body 1 rotating around the first rotating center 41 as shown in FIG. 9B, the human back provides more pressure on the seat massage surface 221, thus the massage driving device 51 needs lower down power to the massage module 3 to provide proper massage service. The pressure sensor 33 can be high sensitivity sensor to sense accuracy pressure, so the massage service can be better. As shown in FIG. 9A, if a human sit at the massage chair, the massage module 3 cannot provide the leg section 15 to human, because the distance between the massage module 3 and the seat massage surface 221 is more than massage distance, the pressure sensor 33 sense no pressure, thus, the massage driving device 51 can turn off the massage module 3 automatically. The instruction sent to the massage module 3 by the massage driving device 51 can be modified in custom, example, the pressure sensor 33 sense no pressure, and the massage module 3 moved to the leg section 15, the massage driving device 51 turns off the power to the massage module 3; for other instance, the massage driving device 51 provides more power as pressure decrease, but the massage driving device 51 provides no power as pressure detected by pressure sensor 33 is zero.

As shown in FIG. 4, the frame body 1 and the leg massage device 23 can be adjusted for custom practice, for example, when the frame body 1 almost lay flat, the leg massage device 23 can keep lowest position or highest position; in addition, the massage service can be designed for special custom, for example, when the frame body 1 rotates around the first rotating center 41, the leg massage device 23 can also rotates, find best posture to human body, to perform best massage service.

The structure of this invention has been clearly elaborated in the aforementioned content. In summary, it contains the following advantages:

(1) the rotation angle between the chair back and the chair seat can be adjusted properly, so human body does not fix the same posture, and able to stretch properly for comfort, also, in any instance, massage service can be provided at least from human neck to human buttock.

(2) the leg section has a downward curve in the invention, so the massage module can provide massage to human thigh when the rotation angle is more than 110 degree, makes the massage service provided by the massage chair of the invention can be more complete.

While the invention has been described by means of specific embodiments, numerous modifications and variations could be made thereto by those skilled in the art without departing from the scope and spirit of the invention set forth in the claims.

What is claimed is:

1. A massage chair, including:

a chair body, capable of carrying human body, and having a chair back and a chair seat, wherein the chair back is located by the chair seat and having a rotation angle between the chair back and chair seat, also adjusted properly by the chair seat for rotating; wherein the chair back has a back massage surface, the chair seat has a seat massage surface, and both are made by leather material;

a frame body, being stiffness frame, and being located within the chair body, also having a rigid bar welded in the frame body, a left frame and right frame; wherein the left frame and right frame have relative shape, and being connected each other by at rigid bar, in addition, the left frame and the right frame of the frame body are both formed internal slide track respectively, and both further comprising:

a back section, being located and fixed in the chair back; wherein the back section of the left frame is connected with the back section of the right frame;

a buttock section, being located in both the chair back and the chair seat, and connecting to the back section; wherein the buttock section has an upward curve; and a leg section, being located under the chair seat, and connecting to the buttock section; wherein the leg section has a downward curve relative to the buttock section; wherein the leg section of the left frame are connected to the leg section of the right frame;

a massage module, being located within the frame body and between the internal slide track, able to slide from the back section, the buttock section to the leg section, and from the leg section, the buttock section to the back section; wherein the massage module can provide a massage service at both the chair back and the chair seat; wherein the massage module touches the back massage surface and the seat massage surface during massage service, and pushes the back massage surface and the seat massage surface respectively to provide the massage service; in addition, the massage module has a plurality of gearwheel and a plurality of sliding wheel, wherein the sliding wheels are disposed by the gearwheels; moreover, the massage module has two massage arm, controlled by electrical motor, able to push and press human body through the chair back and the chair seat; moreover, the massage module has a pressure sensor, sensing pressure from the back massage surface and the seat massage surface;

a supporting shelf, being located and flanked the frame body, connecting to the frame body, having two first rotating center, and capable of carrying the chair seat; wherein the frame body is connected to the first rotating center; and an electrical driver, driving the massage module to provide massage service, also driving the frame body to rotate around the first rotating center, so that, the chair back is adjusted properly by the chair seat for rotating; wherein the pressure sensor senses pressure, and transfers a pressure signal to the electrical driver, the electrical driver then drives the frame body to rotate around the first rotating center, and adjusts the massage service according to the pressure signal.

2. The massage chair of claim 1, wherein the electrical driver includes a massage driving device and a frame body rotating device; wherein the massage module receives power and instruction from the massage driving device to provide massage service; the frame body rotating device connects to the rigid bar of the frame body, and drives the frame body to rotate around the first rotating center, so that, the chair back is adjusted properly by the chair seat for rotating; wherein the pressure sensor senses pressure from the back massage surface and the seat massage surface, and transfers the pressure signal to the massage driving device and the frame body rotating device, then the massage driving device provides power and instruction to the massage module, so the massage module provides massage service according the pressure signal, moreover, the frame body rotating device drives the frame body to rotate around the first rotating center properly.

3. The massage chair of claim 2, wherein the supporting shelf further includes two swing bars; wherein the swing bars connect to the frame body and the first rotating center; wherein the frame body rotating device drives the rigid bar of the frame body, and the frame body rotates around the first rotating center, so the chair back is adjusted properly by the chair seat for rotating.

4. The massage chair of claim 3, wherein the swing bars connects to the buttock section of the frame body.

5. The massage chair of claim 2, wherein the supporting shelf further includes a left supporter, a right supporter and a base; the left supporter and the right supporter are placed on the base relatively, and supporting the chair seat; the two first rotating center are formed at the left supporter and the right supporter respectively; in addition, two second rotating center are formed at the left supporter and the right supporter respectively.

6. The massage chair of claim 5, wherein the chair body further includes a leg massage device, which is relative to the chair back, located by the chair seat, connected to the two second rotating center, and adjusted properly by the chair seat for rotating.

7. The massage chair of claim 6, wherein the electrical driver further includes a leg massage rotating device connected to the leg massage device of the chair body, and driving the leg massage device to rotate around the second rotating center.

8. The massage chair of claim 1, wherein the buttock section has an upward curve of radius within 110 mm to 210 mm.

9. The massage chair of claim 1, wherein the leg section has a downward curve of radius within 90 mm to 270 mm.

10. The massage chair of claim 1, wherein the buttock section has an upward curve connected to the downward curve of the leg section.

11. The massage chair of claim 1, wherein each internal slide track further includes a rack and pinion placing surface and a rack and pinion drive, the rack and pinion drive is fixed on the rack and pinion placing surface; moreover, the gearwheels of the massage module rotates on the rack and pinion drive.

12. The massage chair of claim 11, wherein each internal slide track further includes a sliding wheel accommodating slot; wherein the sliding wheel accommodating slot is connected by the rack and pinion placing surface, and accommodates the sliding wheel of the massage module; wherein the sliding wheel of the massage module and gearwheel of the massage module have the same rotation center.

* * * * *